US009111480B2

(12) United States Patent
Park et al.

(10) Patent No.: US 9,111,480 B2
(45) Date of Patent: Aug. 18, 2015

(54) LIQUID CRYSTAL DISPLAY AND A METHOD OF DRIVING THE SAME BY CONVERTING THREE COLOR INPUT IMAGE SIGNALS BASED ON A HUE SHIFT OF YELLOW

(75) Inventors: Gi Chang Park, Yongin-si (KR); Sang Hyun Lee, Busan (KR); Do Hyoung Kwon, Chungcheongnam-do (KR); Yung Kyung Park, Seoul (KR); Jong Seo Lee, Hwaseong-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 433 days.

(21) Appl. No.: 13/543,533

(22) Filed: Jul. 6, 2012

(65) Prior Publication Data

US 2013/0222436 A1 Aug. 29, 2013

(30) Foreign Application Priority Data

Feb. 23, 2012 (KR) ..... 10-2012-0018606

(51) Int. Cl.
*G09G 5/10* (2006.01)
*G09G 5/06* (2006.01)

(52) U.S. Cl.
CPC ..... *G09G 5/06* (2013.01); *G09G 2300/0452* (2013.01); *G09G 2320/0242* (2013.01); *G09G 2320/0276* (2013.01)

(58) Field of Classification Search
CPC ..... G09G 5/06; G09G 2320/0276; G09G 2320/0242; G09G 2300/0452
USPC ..... 345/690, 88
See application file for complete search history.

(56) References Cited

U.S. PATENT DOCUMENTS

| | | | | |
|---|---|---|---|---|
| 7,355,611 | B2 | 4/2008 | Bianchi et al. | |
| 2002/0000993 | A1* | 1/2002 | Deishi et al. | 345/590 |
| 2005/0219420 | A1* | 10/2005 | Kimura et al. | 348/655 |
| 2006/0290831 | A1 | 12/2006 | You | |
| 2007/0279372 | A1* | 12/2007 | Brown Elliott et al. | 345/102 |
| 2008/0049048 | A1* | 2/2008 | Credelle et al. | 345/690 |
| 2008/0252797 | A1 | 10/2008 | Hamer et al. | |
| 2009/0085926 | A1 | 4/2009 | Kim et al. | |

(Continued)

FOREIGN PATENT DOCUMENTS

| | | |
|---|---|---|
| JP | 10-083445 | 3/1998 |
| JP | 2008-131349 | 6/2008 |

(Continued)

OTHER PUBLICATIONS

Dibakar Raj Pant, Ivar Farup, "Riemannian Formulation of the CIEDE2000 Color Difference Formula", 18th Color Imaging Conference Final Program and Proceedings, 2010 Society for Imaging Science and Technology, pp. 103-108.

(Continued)

*Primary Examiner* — Jonathan Blancha
(74) *Attorney, Agent, or Firm* — F. Chau & Associates, LLC

(57) ABSTRACT

A liquid crystal display that includes a plurality of pixels configured to display four colors, and a color gamut mapping unit configured to convert three color input image signals into four color image signals, wherein when the three color input image signals include yellow, the color gamut mapping unit converts the three color input image signals based on a hue shift of the yellow.

15 Claims, 11 Drawing Sheets

(56) References Cited

U.S. PATENT DOCUMENTS

| | | | | |
|---|---|---|---|---|
| 2009/0141039 | A1* | 6/2009 | Ramanath et al. | 345/590 |
| 2009/0284457 | A1* | 11/2009 | Botzas et al. | 345/102 |
| 2010/0195173 | A1* | 8/2010 | Dalrymple | 358/520 |
| 2011/0234622 | A1* | 9/2011 | Fujita et al. | 345/591 |

FOREIGN PATENT DOCUMENTS

| | | |
|---|---|---|
| JP | 2009-192887 | 8/2009 |
| JP | 2010-049-011 | 3/2010 |
| JP | 2010-156817 | 7/2010 |
| KR | 1020080062185 | 7/2008 |
| KR | 1020080084173 | 9/2008 |
| KR | 100907736 | 7/2009 |

OTHER PUBLICATIONS

Ingmar Lissner, Philipp Urban, "How Perceptually Uniform Can a Hue Linear Color Space Be?", 18th Color Imaging Conference Final Program and Proceedings, 2010 Society for Imaging Science and Technology, pp. 97-102.

* cited by examiner

LIQUID CRYSTAL DISPLAY AND A METHOD OF DRIVING THE SAME BY CONVERTING THREE COLOR INPUT IMAGE SIGNALS BASED ON A HUE SHIFT OF YELLOW

CROSS-REFERENCE TO RELATED APPLICATION

This application claims priority under 35 U.S.C. §119 to Korean Patent Application No. 10-2012-0018606 filed in the Korean Intellectual Property Office on Feb. 23, 2012, the disclosure of which is incorporated by reference herein in its entirety.

BACKGROUND

1. Technical Field

The present invention relates to a liquid crystal display and a driving method thereof.

2. Discussion of the Related Art

A liquid crystal display is one of the most widely used flat panel displays. The liquid crystal display includes two display panels provided with field generating electrodes such as pixel electrodes and a common electrode, and a liquid crystal layer interposed between the display panels. In the liquid crystal display, images are displayed by applying a voltage to the field generating electrodes to generate an electric field in the liquid crystal layer, wherein the electric field determines the direction of liquid crystal molecules in the liquid crystal layer to control the polarization of incident light.

A color filter used in the liquid crystal display generally displays three colors of red, green, and blue. The liquid crystal display may further include a transparent color filter that directly passes white light to improve the luminance of the white color.

However, when a liquid crystal display uses the transparent color filter, the luminance of the white color emitted thereby may be so high that a color impression of yellow may be deteriorated. This deterioration is recognizable by a person, since the wavelength of yellow is about 570 nm to about 590 nm. Accordingly, there is a need to prevent the deterioration of the color impression of yellow in a liquid crystal display.

SUMMARY

A liquid crystal display according to an exemplary embodiment of the present invention includes a plurality of pixels configured to display four colors, and a color gamut mapping unit configured to convert three color input image signals into four color image signals, wherein when the three color input image signals include yellow, the color gamut mapping unit converts the three color input image signals based on a hue shift of the yellow.

The hue shift of the yellow may shift the three color input image signals to a perceptible yellow hue line.

The three color input image signals may be converted from an RGB color space into a CIELAB color space.

The three color input image signals may be positioned at a first point in the CIELAB color space, and the first point may be shifted to a second point on the perceptible yellow hue line.

A chroma of the first point may be substantially the same as a chroma of the second point, and a hue angle of the first point may be larger than a hue angle of the second point.

The color gamut mapping unit may convert the three color input image signals based on the hue shift of the yellow when the three color input image signals include white.

The color gamut mapping unit may convert the three color input image signals based on the hue shift of the yellow when a hue of the yellow in the three color input image signals is smaller than 87.5.

The liquid crystal display may further include a gamma correction unit configured to compensate a gamma value of the three color input image signals.

The liquid crystal display may further include a scaling unit configured to scale the four color image signals.

The liquid crystal display may further include a rendering and dithering unit configured to render and dither the four color image signals.

The pixels may include a transparent color filter configured to pass white light.

The four colors may include red, green, blue, and white.

A luminance of the white in the four colors may be maintained.

A driving method of a liquid crystal display according to an exemplary embodiment of the present invention includes: receiving three color input image signals at the liquid crystal display; and converting the three color input image signals into four color image signals, wherein when the three color input image signals include yellow, the three color input image signals are converted based on a hue shift of the yellow.

The hue shift of the yellow may shift the three color input image signals to a perceptible yellow hue line.

The three color input image signals may be converted from an RGB color space into a CIELAB color space.

The three color input image signals may be positioned at a first point in the CIELAB color space, and the first point may be shifted to a second point on the perceptible yellow hue line.

A chroma of the first point may be the substantially the same as a chroma of the second point, and a hue angle of the first point may be larger than a hue angle of the second point.

The three color input image signals may be converted based on the hue shift of the yellow when the three color input image signals include white.

The three color input image signals may be converted based on the hue shift of the yellow when a hue of the yellow in the three color input image signals is smaller than 87.5.

A liquid crystal display according to an exemplary embodiment of the present invention includes a plurality of pixels including red, green, blue and white color filters; and a driver configured to execute a hue shift algorithm in response to an input image signal including yellow and white, wherein the hue shift algorithm shifts a hue of the yellow when a chroma of the yellow is less than a predetermined value, and the driver is configured to output the yellow with the shifted hue to the pixels.

DETAILED DESCRIPTION OF THE EMBODIMENTS

Figure 1:
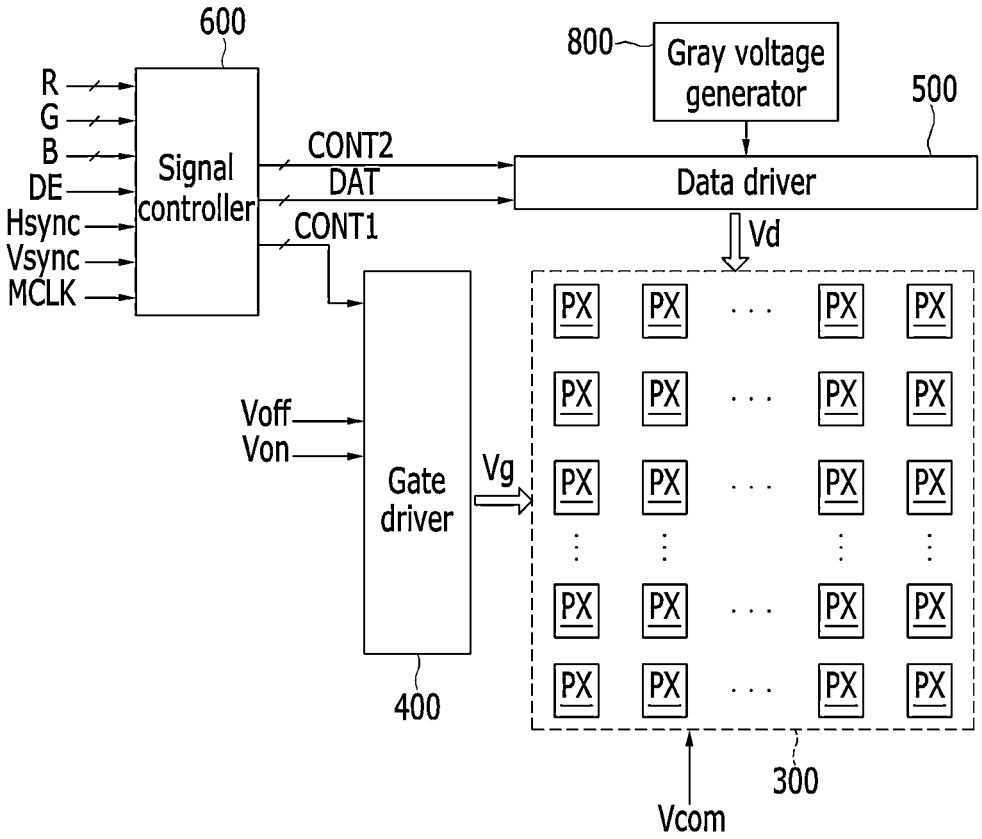
FIG. 1 is a schematic view of a liquid crystal display according to an exemplary embodiment of the present invention.

Exemplary embodiments of the present invention will be described more fully hereinafter with reference to the accompanying drawings. However, the present invention may be embodied in various different ways and should not be construed as limited to the embodiments disclosed herein.

In the drawings, the thickness of layers, films, panels, regions, etc., may be exaggerated for clarity. Like reference numerals may designate like elements throughout the specification and drawings. It will be understood that when an element such as a layer, film, region, or substrate is referred to as being "on" another element, it may be directly on the other element or intervening elements may also be present.

FIG. 1 is a schematic view of a liquid crystal display according to an exemplary embodiment of the present invention.

Referring to FIG. 1, a liquid crystal panel assembly 300 includes a plurality of pixels PX arranged in an approximate matrix. The plurality of pixels PX are connected to a plurality of signal lines. The signal lines include a plurality of gate lines for transferring gate signals (also referred to as "scanning lines") and a plurality of data lines for transferring data signals.

A gray voltage generator 800 generates two gray voltage sets (or reference gray voltage sets) relating to the transmittance of the pixels PX. One of the two sets has a positive value for a common voltage Vcom and the other has a negative value.

A gate driver 400 is connected to the gate lines of the liquid crystal panel assembly 300 to apply a gate signal or gate voltage Vg that is configured by combining a gate-on voltage Von and a gate-off voltage Voff to the gate lines.

A data driver 500 is connected to the data lines of the liquid crystal panel assembly 300 to select the gray voltages from the gray voltage generator 800 and apply the selected gray voltages to the pixels PX as a data voltage Vd. However, when the gray voltage generator 800 does not supply all voltages for all grays, but supplies only a predetermined number of the gray voltages, the data driver 500 divides the gray voltages to generate gray voltages for the entire grays and selects a data signal from among the divided gray voltages.

A signal controller 600 controls the gate driver 400 and the data driver 500.

Each of the drivers 400 and 500, the signal controller 600, and the gray voltage generator 800 may be directly mounted on the liquid crystal panel assembly 300 in at least one integrated circuit (IC) chip form or mounted on a flexible printed circuit film (not shown) to be attached to the liquid crystal panel assembly 300 in a tape carrier package (TCP) form. Alternatively, the drivers 400 and 500, the signal controller 600, and the gray voltage generator 800 may be integrated to the liquid crystal panel assembly 300 together with the signal lines and thin film transistor switching elements of the pixels PX. Further, all of the drivers 400 and 500, the signal controller 600, and the gray voltage generator 800 may be integrated in a single chip, and in this case, at least one of the drivers 400 and 500, the signal controller 600, and the gray voltage generator 800 or at least one circuit element configuring the drivers 400 and 500, the signal controller 600, and the gray voltage generator 800 may be disposed outside the single chip.

The signal controller 600 receives input image signals R, G, and B and an input control signal for controlling the display of the input image signals R, G and B from an external graphics controller (not shown). The input image signals R, G, and B have luminance information of each pixel PX and the luminance has a predetermined number, for example, 1024 ($=2^{10}$), 256 ($=2^{8}$), or 64 ($=2^{6}$) grays. Examples of the input control signal include a vertical synchronization signal Vsync, a horizontal synchronization signal Hsync, a main clock signal MCLK, a data enable signal DE, and the like.

The signal controller 600 processes the input image signals R, G, and B to be suitable for the operating conditions of the liquid crystal panel assembly 300 and the data driver 500 based on the input image signals R, G, and B and the input control signal. After the signal controller 600 generates a gate control signal CONT1, a data control signal CONT2, a backlight control signal, and the like, the signal controller 600 transmits the gate control signal CONT1 to the gate driver 400 and outputs the data control signal CONT2 and the processed image signal DAT to the data driver 500. The output image signal DAT has a predetermined number of values (or grays) and is a digital signal.

The gate control signal CONT1 includes a scanning start signal for instructing a scanning to start and at least one clock signal for controlling an output period of the gate-on voltage Von. The gate control signal CONT1 may further include an output enable signal for limiting a time duration of the gate-on voltage Von.

The data control signal CONT2 includes a horizontal synchronization start signal for notifying a start of the transmission of image data for the pixels PX of one row and a load signal LOAD for instructing the application of the data signal to the data lines, and a data clock signal. The data control signal CONT2 may further include an inversion signal for inverting a voltage polarity of the data signal for the common voltage Vcom (which hereinafter may be referred to as a "polarity of the data signal").

According to the data control signal CONT2 output from the signal controller 600, the data driver 500 receives the digital image signal DAT for the pixels PX of one row and selects a gray voltage corresponding to each pixel's PX digital image signal DAT, and as a result, converts the digital image signal DAT into an analog data signal and then applies the analog data signal to the corresponding data lines. The number of gray voltages generated by the gray voltage generator 800 is the same as the number of grays represented by the digital image signal DAT.

The gate driver 400 applies the gate-on voltage Von to the gate lines according to the gate control signal CONT1 from the signal controller 600 to turn on the switching element connected to the gate lines. Then, the data signal applied to the data lines is applied to the corresponding pixel PX through the turned-on switching element.

A difference between the voltage of the data signal applied to the pixel PX and the common voltage Vcom is represented as a charged voltage of a liquid crystal capacitor, in other words, a pixel voltage. Liquid crystal molecules are arranged differently according to the size of the pixel voltage, and accordingly, the polarization of light passing through a liquid crystal layer is changed. A change of the polarization is represented as a change in the transmittance of light by a polarizer attached to the liquid crystal panel assembly 300, such that the pixel PX displays luminance represented by the gray of the image signal DAT.

By repeating the process in a unit of 1 horizontal period (also written as "1H" and which is the same as one period of the horizontal synchronization signal Hsync and the data enable signal DE), the gate-on voltage Von is sequentially applied to the plurality of gate lines to apply the data signal to the plurality of pixels PX, thereby displaying images of one frame.

One frame ends, the next frame starts, and a state of the inversion signal applied to the data driver 500 is controlled so that the polarity of the data signal applied to each pixel PX is opposite a polarity of the previous frame (for example, "frame inversion"). In this case, the polarity of the data signal flowing through one data line may be changed according to a characteristic of the inversion signal in one frame (for example, row inversion and dot inversion) or the polarities of the data signals applied to one pixel PX row may also be different from each other (for example, column inversion and dot inversion).

Figure 2:
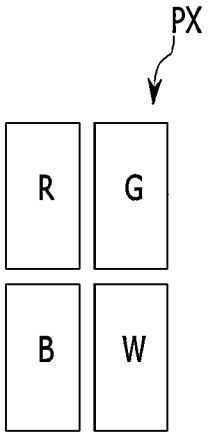
FIG. 2 is a layout view of a pixel PX of a liquid crystal display according to an exemplary embodiment of the present invention.

FIG. 2 is a layout view of a pixel PX in a liquid crystal display according to an exemplary embodiment of the present invention.

Referring to FIG. 2, in a four-color liquid crystal display, four color filters (R, G, B, and W) corresponding to the pixel PX are shown. For example, there are a red color filter (R), a green color filter (G), a blue color filter (B), and a transparent color filter (W) that passes white light. In the four-color liquid crystal display, a number and a position of the color filters forming one group may be variously changed, and the color filters forming one group may include at least one red color filter (R), at least one green color filter (G), at least one blue color filter (B), and at least one transparent color filter (W). For example, two red color filters (R), two green color filters (G), one blue color filter (B), and one transparent color filter (W) may form one group.

Figure 3:
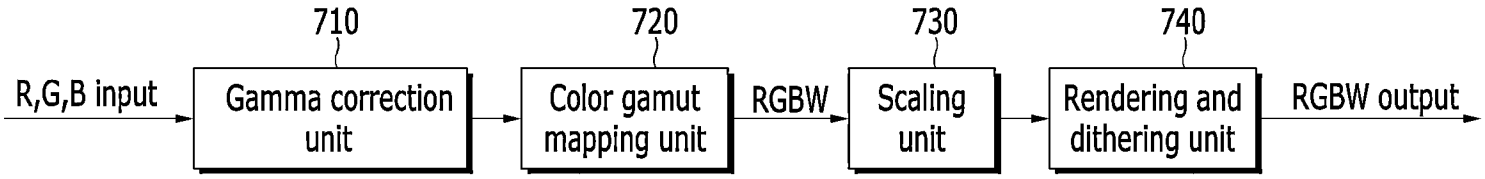
FIG. 3 is a schematic view of a driver of a liquid crystal display according to an exemplary embodiment of the present invention.
Figure 4:
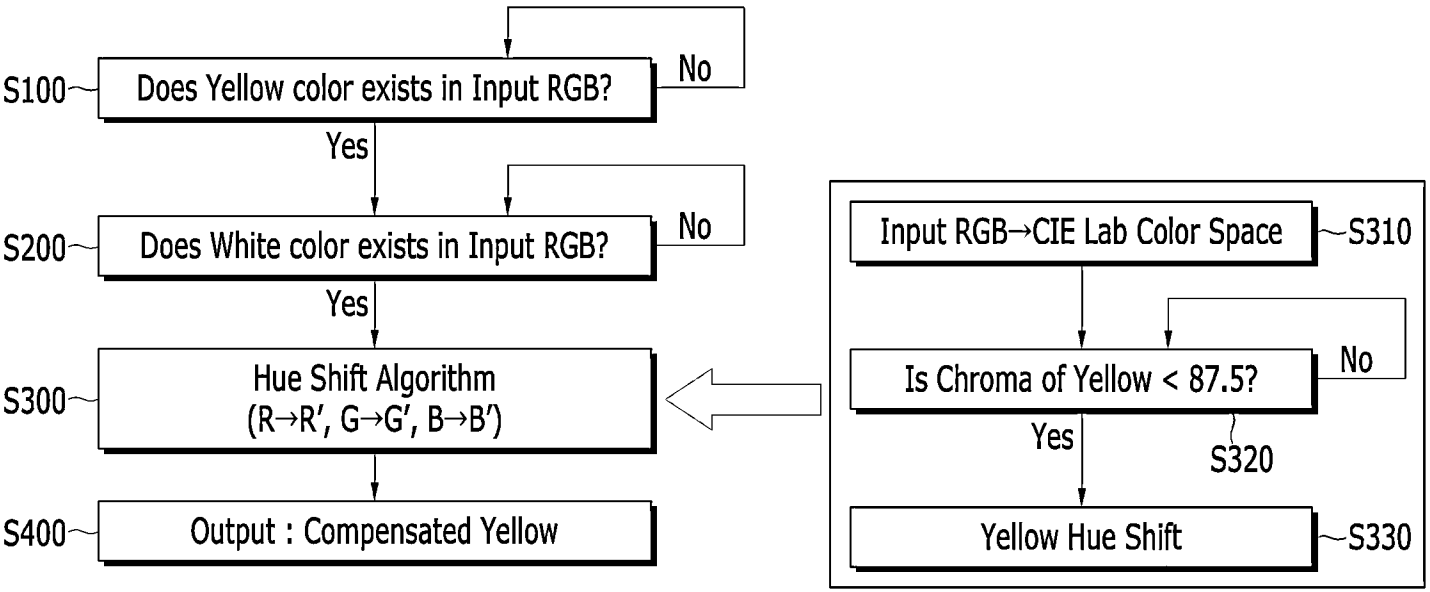
FIG. 4 is a flowchart showing a driving method of a liquid crystal display according to an exemplary embodiment of the present invention.

FIG. 3 is a schematic view of a driver of a liquid crystal display according to an exemplary embodiment of the present invention, and FIG. 4 is a flowchart showing a driving method of a liquid crystal display according to an exemplary embodiment of the present invention.

Referring to FIG. 3, a driver of the liquid crystal display includes a gamma correction unit 710, a color gamut mapping unit 720, a scaling unit 730, and a rendering and dithering unit 740. These units are connected to a processor and a memory to execute a calculation.

The gamma correction unit 710 compensates a gamma value of the input image signals R, G, and B. For example, the gamma value of the input image signals R, G, and B may be compensated from 1.0 to 2.2.

The color gamut mapping unit 720 converts the three color input image signals R, G, and B into four color image signals R, G, B, and W. In addition, the color gamut mapping unit 720 may execute the driving method of FIG. 4 which will be described later.

The scaling unit 730 scales the four color image signals R, G, B, and W.

The rendering and dithering unit 740 renders and dithers the four color image signals R, G, B, and W.

Referring to FIG. 4, the driver of the liquid crystal display determines whether the input image signals R, G, and B include a yellow color (S100).

When the input image signals R, C, and B include a yellow color, the driver of the liquid crystal display determines whether the input image signals R, G, and B include a white color (S200). If the input image signals R, G, and B do not include yellow, the driver repeats (S100) for next input image signals R, G, and B. In the four-color liquid crystal display, when the input image signals R, G, and B do not include the white color, the color impression of yellow is not deteriorated. In this case, the driver will repeat (S200) for next input image signals R, G, and B that include yellow.

When the input image signals R, G, and B include the yellow and the white, the driver of the liquid crystal display executes a hue shift algorithm (S300).

In the hue shift algorithm, the driver of the liquid crystal display converts the three color image signals R, G, and B from an RGB color space to a CIELAB color space (S310).

The driver of the liquid crystal display determines whether the chroma of the yellow is smaller than a predetermined value in the CIELAB color space (S320). When the chroma of the yellow is smaller than a predetermined value in the CIELAB color space, the color impression of yellow may be deteriorated. For example, when the predetermined value is 87.5 and the chroma of the yellow is smaller than 87.5, the color impression of yellow recognized by a viewer of the four-color liquid crystal display may be deteriorated.

When the chroma of the yellow is smaller than the predetermined value in the CIELAB color space, the driver of the liquid crystal display shifts the hue of the yellow (S330). Otherwise, the driver repeats (S320) for next input image signals R, G, and B that include yellow and white.

As a result of executing the hue shift algorithm, the driver of the liquid crystal display outputs the yellow whose color impression has been compensated (S400).

A method of shifting the yellow by the driver of the liquid crystal display will be described with reference to FIG. 5A, FIG. 5B, FIG. 6A, and FIG. 6B.

Figure 5A:
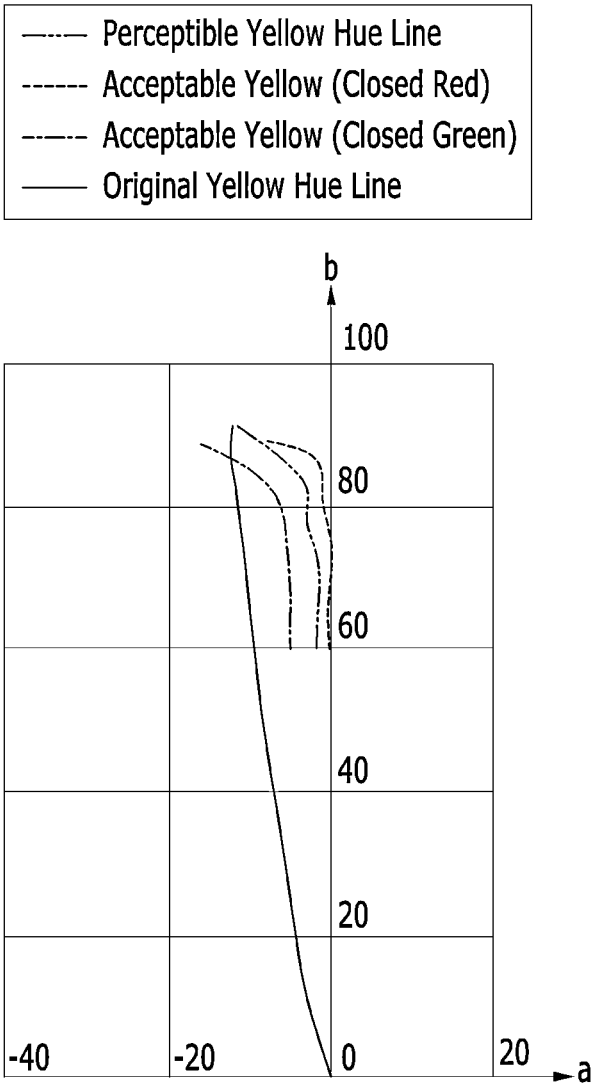
FIG. 5A and FIG. 5B are graphs showing a hue line of yellow in a CIELAB color space.
Figure 5B:
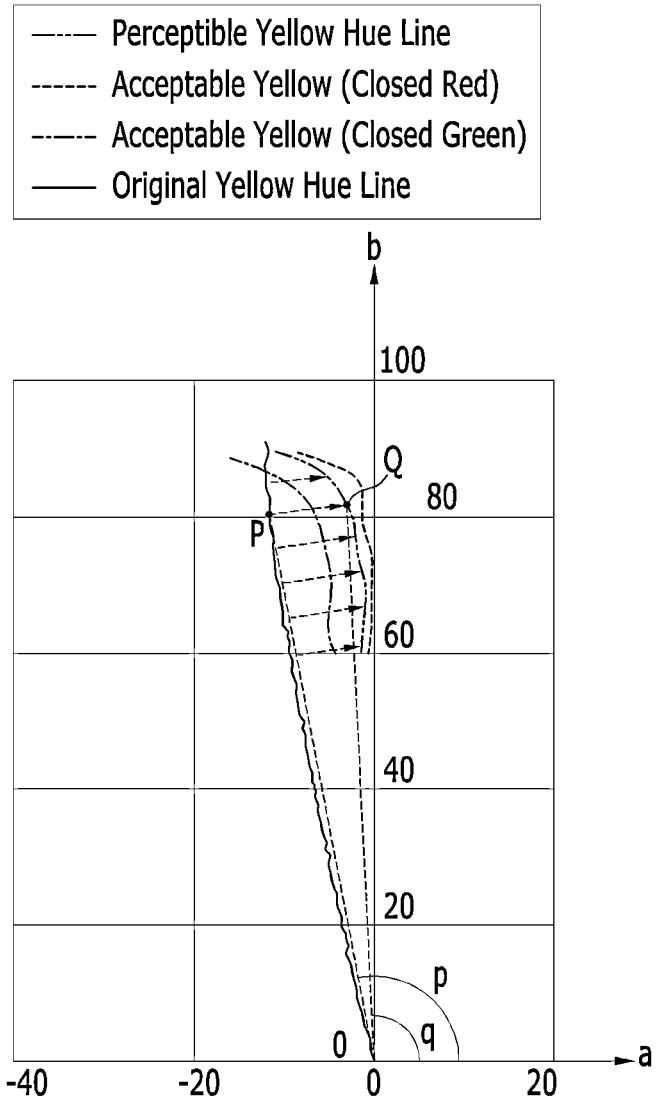
Figure 6A:
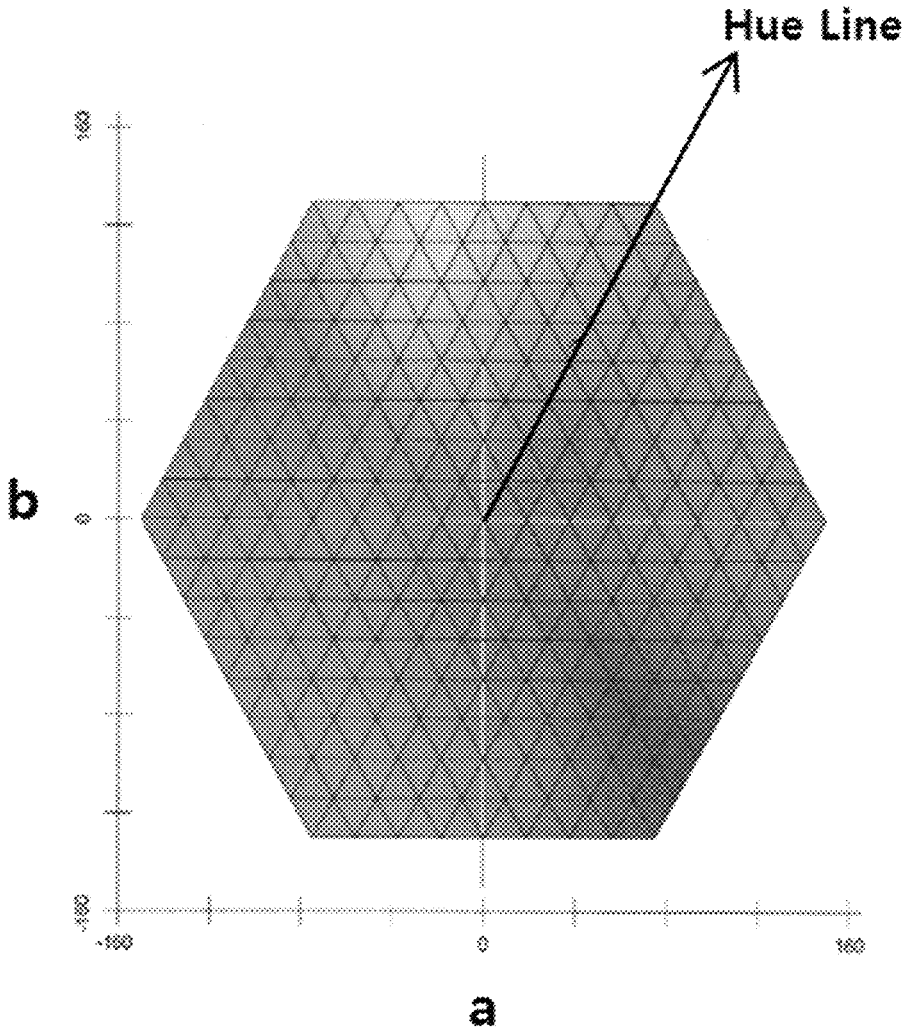
FIG. 6A is a graph showing a basic CIELAB color space.
Figure 6B:
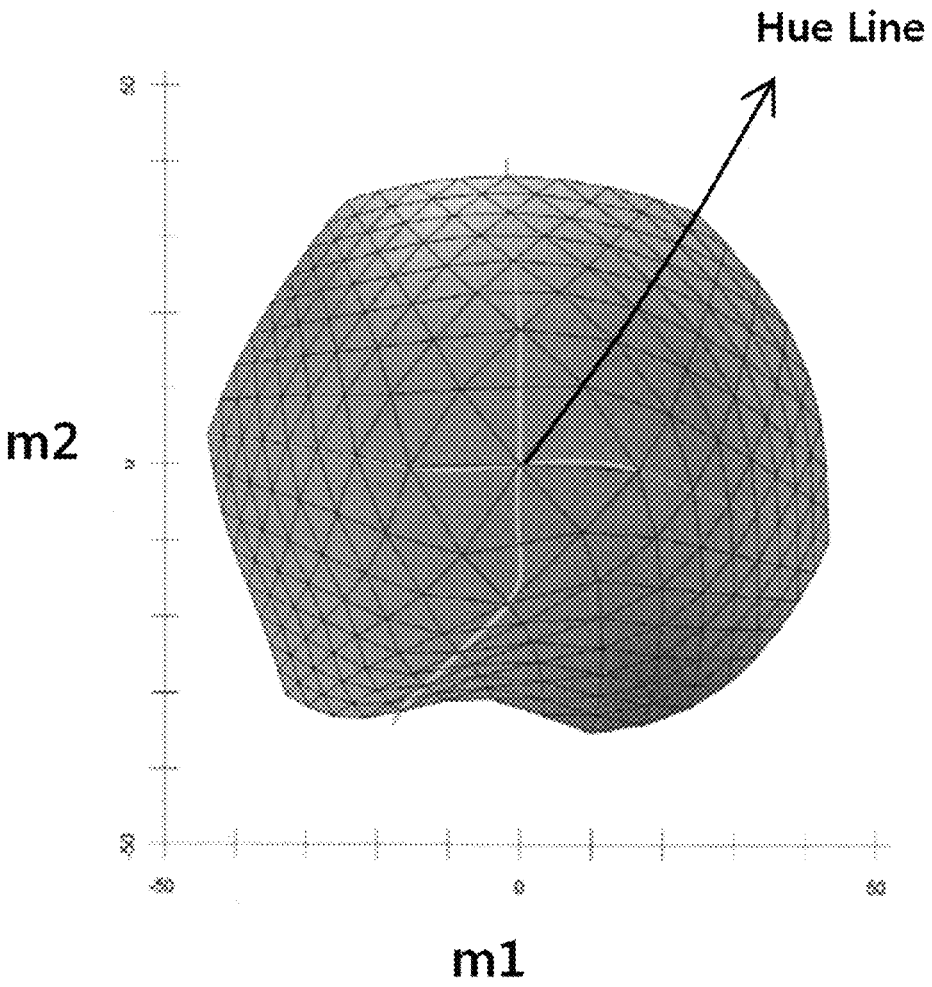
FIG. 6B is a graph showing a perceptual CIELAB color space.

FIG. 5A and FIG. 5B are graphs showing a hue line of yellow in a CIELAB color space, FIG. 6A is a graph showing a basic CIELAB color space, and FIG. 6B is a graph showing a perceptual CIELAB color space.

Referring to FIG. 6A, in the CIELAB color space, L represents lightness in a direction of a z-axis (not shown) and is expressed as a step of 0 to 100. a to +a are expressed as red, and −a is expressed as green. b to +b are expressed as yellow, and −b is expressed as blue. When displaying an arbitrary point in the CIELAB color space, a distance from a starting point to the arbitrary point is the chroma, and a rotation angle from the +a axis to a line connecting the starting point and the arbitrary point in a counterclockwise direction is a hue angle. The color existing on the hue line is a color having the same hue. In general, in the liquid crystal display device, color tuning is executed according to the hue line to prevent a color change, and this tuning adjusts a white balance.

Referring to FIG. 6B, the uniform color space recognized by a viewer is different from FIG. 6A, and here, a converted coordinate system is referred to as m1 and m2.

Referring to FIG. 5A, an original yellow hue line is data measuring a yellow output from the liquid crystal display for each gray. A perceptible yellow hue line is data displaying a yellow recognized by the viewer for each gray. An acceptable yellow is data displaying a range to be recognized as yellow by the viewer. In addition, an acceptable yellow includes data of a red direction and data of a green direction.

Referring to FIG. 5B, when the converted data is data corresponding to a point P in (S310), the chroma of the point P is the distance to the point P from the starting point and is smaller than about 87.5 (S320), and the point P is shifted to a point Q (S330). The chroma of the point P and the chroma of the point Q are substantially equal to each other, and the hue angle (p) of the point P and the hue angle (q) of the point Q are different from each other. For example, the hue angle (q) of the point Q is smaller than the hue angle (p) of the point P.

The image data corresponding to the original yellow hue line is hue-shifted to image data corresponding to the perceptible yellow hue line such that the four-color liquid crystal display may prevent the deterioration of the color impression of yellow although the chroma of the yellow is smaller than the predetermined value.

The deterioration of the color impression of yellow of a conventional four-color liquid crystal display will be described with reference to FIG. 7A to FIG. 7C.

Figure 7A:
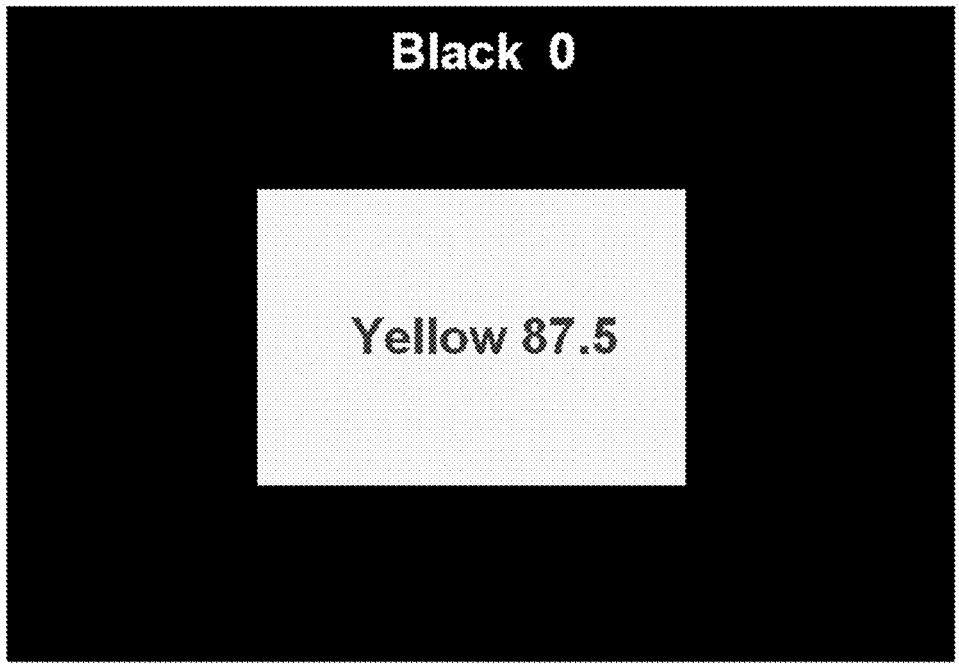
FIG. 7A to FIG. 7C are views showing a simultaneous contrast effect.
Figure 7B:
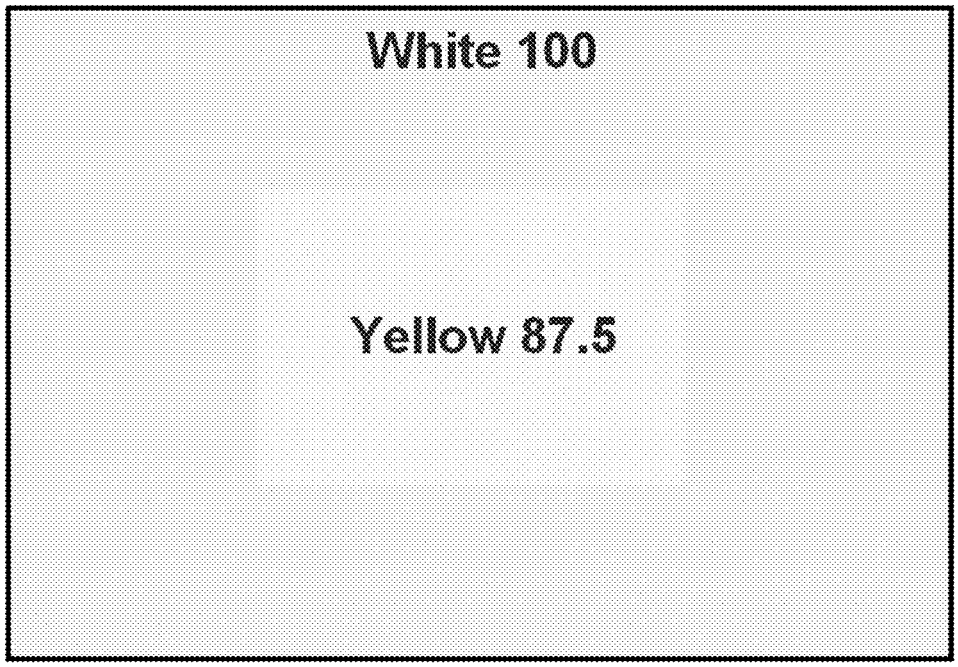
Figure 7C:
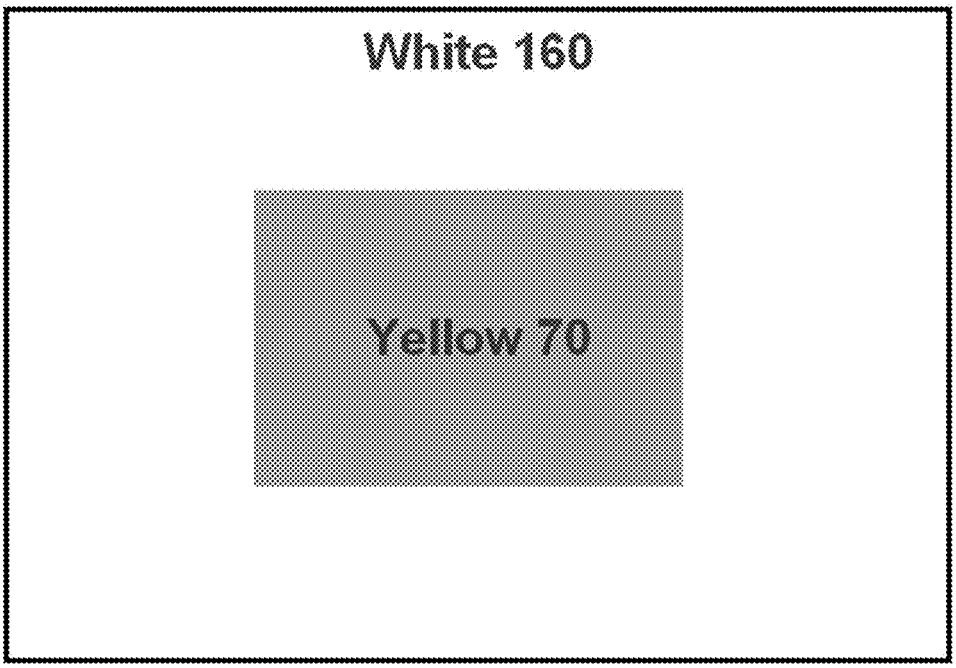

FIG. 7A to FIG. 7C are views showing a simultaneous contrast effect.

FIG. 7A and FIG. 7B show the simultaneous contrast effect of the conventional three-color liquid crystal display, and show that the gray of yellow of a black background and the gray of yellow of a white background are equal to each other at 87.5; however, the yellow of the black background may be recognized as being brighter than the yellow of the white background. FIG. 7C shows yellow of the white background in the conventional four-color liquid crystal display, and the brightness of white in the four-color liquid crystal display is relatively strong such that the luminance ratio of white and yellow may be about 160:70, and the color impression of yellow may be deteriorated. To improve the color impression of yellow in the conventional four-color liquid crystal display, the luminance of white may be reduced; however, the luminance ratio of white and yellow may be only about 100:70 to about 100:80 and anything more than 100:87.5 may be difficult to achieve, and as a result, decreasing the luminance of white is limited. In addition, the gray value of white is decreased to decrease the luminance of white while maintaining the brightness of a backlight of the conventional four-color liquid crystal display such that the four-color liquid crystal display may not be driven with high brightness and low power.

However, the four-color liquid crystal display according to an exemplary embodiment of the present invention shifts the hue of yellow to improve the color impression of yellow without reducing the luminance of white, and thereby the four-color liquid crystal display according to an exemplary embodiment of the present invention realizes high brightness and low power.

An exemplary embodiment of the present invention may improve the color impression of yellow, and a four-color liquid crystal display with high brightness and low power consumption may be realized.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A liquid crystal display, comprising:

a plurality of pixels configured to display four colors; and a color gamut mapping unit configured to convert three color input image signals into four color image signals, wherein when the three color input image signals comprise yellow, the color gamut mapping unit converts the three color input image signals based on a hue shift of the yellow, wherein when a chroma of the yellow is smaller than a predetermined value in a CIELAB color space, only a hue of the yellow is shifted to convert the three color input image signals, wherein the hue shift of the yellow shifts the three color input image signals to a perceptible yellow hue line, wherein the three color input image signals are converted from an RGB color space into the CIELAB color space, and wherein the three color input image signals are positioned at a first point in the CIELAB color space on an original yellow hue line, and the first point is shifted across an acceptable yellow line to a second point on the perceptible yellow hue line.

2. The liquid crystal display of claim 1, wherein a chroma of the first point is substantially the same as a chroma of the second point, and a hue angle of the first point is larger than a hue angle of the second point.

3. The liquid crystal display of claim 1, wherein the color gamut mapping unit converts the three color input image signals based on the hue shift of the yellow when the three color input image signals comprise white.

4. The liquid crystal display of claim 3, wherein the color gamut mapping unit converts the three color input image signals based on the hue shift of the yellow when a hue of the yellow in the three color input image signals is smaller than 87.5.

5. The liquid crystal display of claim 1, further comprising a gamma correction unit configured to compensate a gamma value of the three color input image signals.

6. The liquid crystal display of claim 5, further comprising a scaling unit configured to scale the four color image signals.

7. The liquid crystal display of claim 6, further comprising a rendering and dithering unit configured to render and dither the four color image signals.

8. The liquid crystal display of claim 1, wherein the pixels comprise a transparent color filter configured to pass white light.

9. The liquid crystal display of claim 1, wherein the four colors comprise red, green, blue, and white.

10. The liquid crystal display of claim 9, wherein a luminance of the white in the four colors is maintained.

11. A method of driving a liquid crystal display, comprising:

receiving three color input image signals at the liquid crystal display; and converting the three color input image signals into four color image signals, wherein when the three color input image signals comprise yellow, the three color input image signals are converted based on a hue shift of the yellow, wherein when a chroma of the yellow is smaller than a predetermined value in a CIELAB color space, only a hue of the yellow is shifted to convert the three color input image signals, wherein the hue shift of the yellow shifts the three color input image signals to a perceptible yellow hue line, wherein the three color input image signals are converted from an RGB color space into the CIELAB color space, and wherein the three color input image signals are positioned at a first point in the CIELAB color space on an original yellow line, and the first point is shifted across an acceptable yellow line, to a second point on the perceptible yellow hue line.

12. The method of claim 11, wherein a chroma of the first point is the substantially the same as a chroma of the second point, and a hue angle of the first point is larger than a hue angle of the second point.

13. The method of claim 11, wherein the three color input image signals are converted based on the hue shift of the yellow when the three color input image signals comprise white.

14. The method of claim 13, wherein the three color input image signals are converted based on the hue shift of the yellow when a hue of the yellow in the three color input image signals is smaller than 87.5.

15. A liquid crystal display, comprising:

a plurality of pixels including red, green, blue and white color filters; and a driver configured to execute a hue shift algorithm in response to an input image signal including yellow and white, wherein the hue shift algorithm shifts only a hue of the yellow when a chroma of the yellow is less than a predetermined value of 87.5, and the driver is configured to output the yellow with the shifted hue to the pixels.

* * * * *